US010480737B1

(12) United States Patent
Ahn et al.

(10) Patent No.: US 10,480,737 B1
(45) Date of Patent: Nov. 19, 2019

(54) LAMP APPARATUS FOR VEHICLE

(71) Applicants: Hyundai Motor Company, Seoul (KR); Kia Motors Corporation, Seoul (KR)

(72) Inventors: Byoung Suk Ahn, Gyeonggi-do (KR); Seung Hyeok Chang, Gyeonggi-do (KR); Jung Wook Lim, Seoul (KR); Ki Hong Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/200,495

(22) Filed: Nov. 26, 2018

(30) Foreign Application Priority Data

Jul. 25, 2018 (KR) ..... 10-2018-0086805

(51) Int. Cl.
*F21S 41/20* (2018.01)
*F21S 41/36* (2018.01)
*F21S 41/135* (2018.01)
*F21W 102/13* (2018.01)

(52) U.S. Cl.
CPC ..... *F21S 41/135* (2018.01); *F21S 41/285* (2018.01); *F21S 41/36* (2018.01); *F21W 2102/13* (2018.01)

(58) Field of Classification Search
CPC ..... F21S 41/135; F21S 41/285; F21S 41/36
See application file for complete search history.

(56) References Cited

U.S. PATENT DOCUMENTS 5,748,369 A * 5/1998 Yokota ..... G02B 27/283 349/9

FOREIGN PATENT DOCUMENTS

KR 20130048540 5/2013

* cited by examiner

*Primary Examiner* — Thomas M Sember
(74) *Attorney, Agent, or Firm* — Morgan, Lewis & Bockius LLP

(57) ABSTRACT

A lamp apparatus for a vehicle which radiates only a p-polarized beam without radiating an s-polarized beam which is reflected by water collecting on a road surface by filtering light which is radiated to a road surface which is wet by rain, preventing reflection of light by water, whereby it is possible to prevent light from blinding the people in oncoming vehicles, so safety from oncoming vehicles is secured and since light having a uniform waveform is radiated, lighting feeling is improved.

15 Claims, 6 Drawing Sheets

LAMP APPARATUS FOR VEHICLE

CROSS REFERENCE TO RELATED APPLICATION

The present application claims priority of Korean Patent Application No. 10-2018-0086805 filed on Jul. 25, 2018, the entire contents of which are incorporated herein for all purposes by this reference.

BACKGROUND OF THE INVENTION

Field of the Invention

The present invention relates to a lamp apparatus for a vehicle, the lamp apparatus preventing light which is radiated to the ground from blinding people in other vehicles.

Description of Related Art

In general, vehicles are provided with lighting systems for more clearly showing objects in the front area of the vehicles in nighttime driving and for showing the driving states of the vehicles to other vehicles or people in the streets. The lamp, which is called a headlight, is a light that lights the road which is ahead in the driving direction of a vehicle.

Such automotive lamps are classified into a headlamp, a fog lamp, a turn signal, a brake light, and a reversing light etc., and are set to radiate light in different direction on the surfaces of roads.

In general, a low beam is radiated from headlamps in a driving situation and a high beam is radiated in specific situations. The low beam lights the surface of a road in a driving route, but when it rains, the ground is wet, so that the light radiated to a road surface is irregularly reflected and blinds the people in oncoming vehicles. That is, when a layer of water is formed on a road surface by rain, light radiated to the road surface is reflected by the layer of water, causing dazzling.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a lamp apparatus for a vehicle, the lamp apparatus preventing light which is radiated to a road surface from blinding people in oncoming vehicles by being reflected by water collecting on a road surface, when it rains and the road surface is wet.

In accordance with an aspect of the present invention, there is provided a lamp apparatus configured for a vehicle, the lamp apparatus including: a light source that radiates light; a polarizing filter that receives the light radiated from the light source and reflects forward a first-directional polarized beam and transmits a second-directional polarized beam by transmitting or reflecting the incident light, depending on polarizing directions; a reflecting mirror that receives the second-directional polarized beam that has passed through the polarizing filter, and reflects the incident second-directional polarized beam forward thereof; and a wavelength plate which is disposed ahead of the reflecting mirror, receives the second-directional polarized beam reflected by the reflecting mirror, and converts the incident light into a first-directional polarized beam which is the same as the first-directional polarized beam reflected by the polarizing filter, in which the light radiated from the light source is sent out as the same first-directional polarized beam.

The polarizing filter and the reflecting mirror are disposed in a traveling direction of the light radiated from the light source and the polarizing filter reflects a p-polarized beam of the light radiated from the light source and transmits an s-polarized beam, so that the s-polarized beam reaches the reflecting mirror.

The wavelength plate is configured to convert the s-polarized beam reflected by the reflecting mirror into a p-polarized beam.

The lamp apparatus may further include a reflector which is disposed ahead of the polarizing filter and the reflecting mirror, receives the first-directional polarized beam reflected by the polarizing filter and the first-directional polarized beam converted by the reflecting mirror and the wavelength plate, and changes the course of the incident light so that the light is sent out to a road surface.

The reflector may include: a first lens unit that receives the first-directional polarized beam reflected by the polarizing filter and reflects the incident polarized beam to a road surface; and a second lens unit that receives the second-directional polarized beam converted by the reflecting mirror and the wavelength plate and reflects the incident polarized beam to the road surface.

The first lens unit a light inlet portion that receives the polarized beam reflected by the polarizing filter and a light outlet portion through which the polarized beam traveling inside through the light inlet portion thereof is sent out; the second lens unit has a light inlet portion that receives the polarized beam converted by the reflecting mirror and the wavelength plate and a light outlet portion through which the polarized beam traveling inside through the light inlet portion thereof is sent out; and the light outlet portion of the first lens unit and the light outlet portion of the second lens unit extend and connected to each other in an arrangement direction of the polarizing filter and the reflecting mirror.

Aspheric lenses having a predetermined radius of curvature are disposed in the light inlet portions of the first lens unit and the second lens unit, and aspheric reflecting surfaces having a predetermined radius of curvature to totally reflect light refracting through the light inlet portions to the light outlet portions are formed at the first lens unit and the second lens unit.

Several optics or notches are formed at the light outlet portions of the first lens unit and the second lens unit, so that the light that has passed through the light outlet portions are diffused.

The light source may further include a condenser that converts radiated light into collimated light, and the widths of the first lens unit and the second lens unit are larger than the width of the light that has passed through the condenser.

The reflector may include: a condensing mirror which is positioned to receive the first-directional polarized beam reflected by the polarizing filter and the first-directional polarized beam converted by the reflecting mirror and the wavelength plate and condenses light at a focus by reflecting the incident polarized beams; a diffusing lens which is positioned at a focus where the polarized beams are condensed by the condensing mirror and diffuses the incident polarized beams; and a reflecting member that reflects the light diffused by the diffusing lens to a road surface on which a vehicle is driven.

The width of the condensing mirror is larger than the entire arrangement distance of the polarizing filter and the reflecting mirror.

The height of the reflecting member is larger than the heights of the condensing mirror, the polarizing filter, and the reflecting mirror.

A lamp apparatus configured for a vehicle which has the structure described above radiates only a p-polarized beam without radiating an s-polarized beam which is reflected by water collecting on a road surface by filtering light which is radiated to a road surface which is wet by rain, preventing reflection of light by water. Therefore, it is possible to prevent light from blinding the people in oncoming vehicles, so safety from oncoming vehicles is secured. Furthermore, since light having a uniform waveform is radiated, lighting feeling is improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
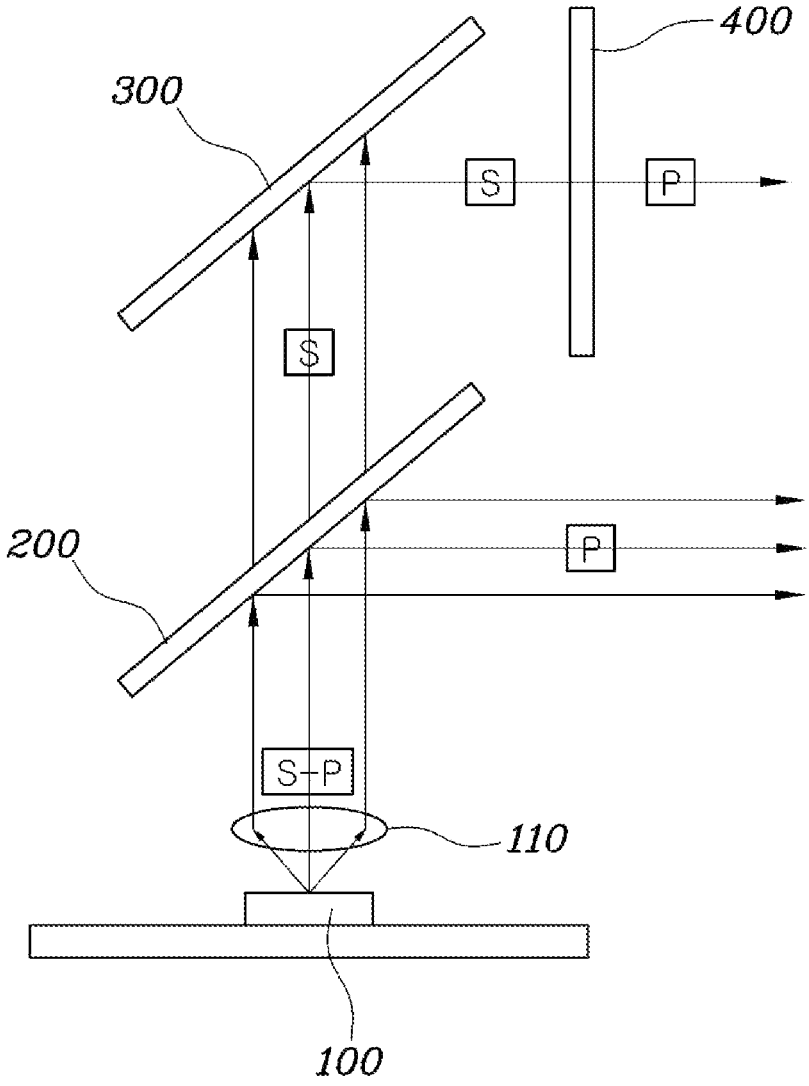
FIG. 1 is a view showing a lamp apparatus configured for a vehicle according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

A lamp apparatus configured for a vehicle according to an exemplary embodiment of the present invention is described hereafter with reference to the accompanying drawings.

Figure 2:
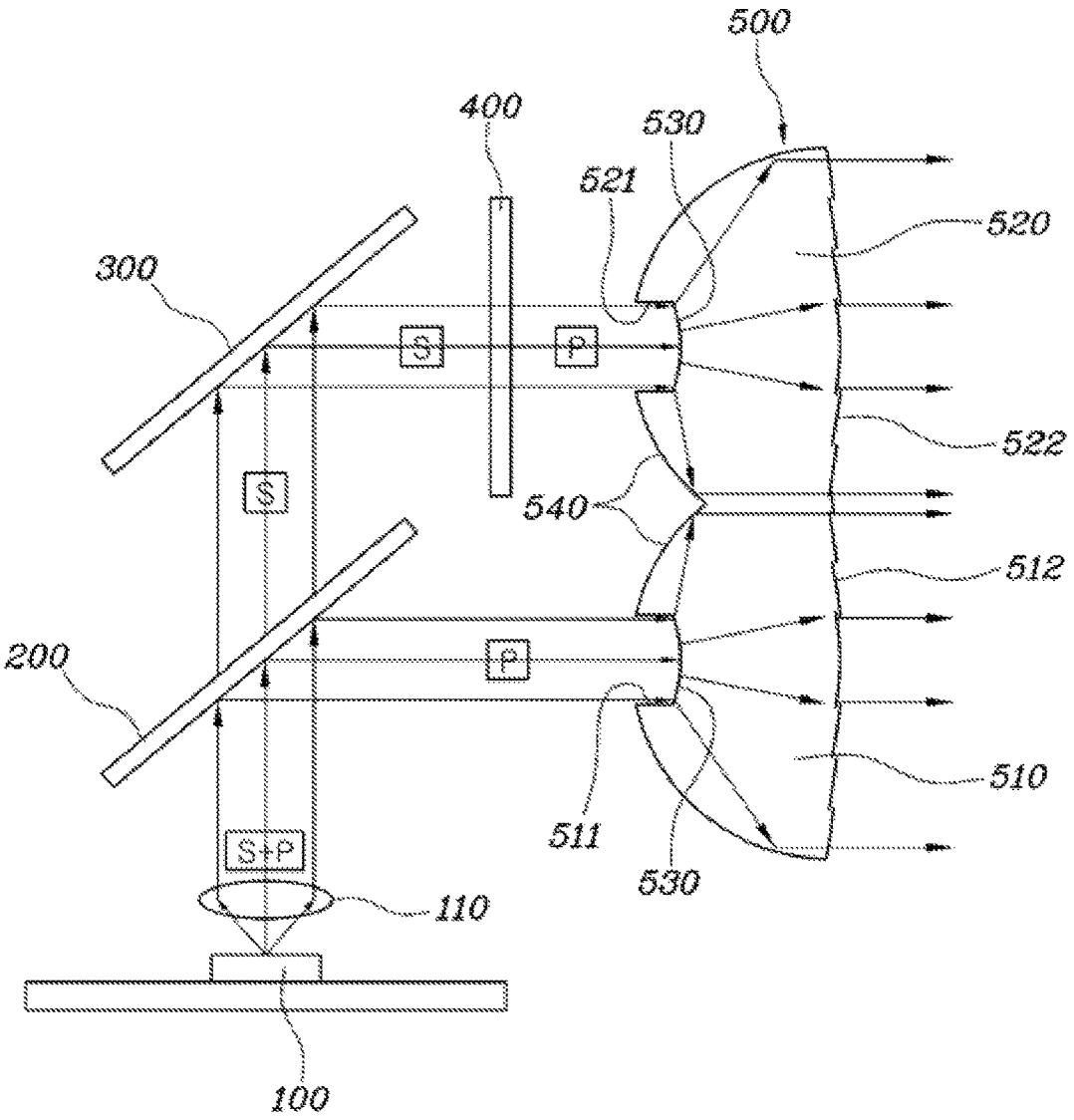
FIG. 2 and FIG. 3 are views for explaining various exemplary embodiments of a reflector according to the lamp apparatus configured for a vehicle shown in FIG. 1.
Figure 3:
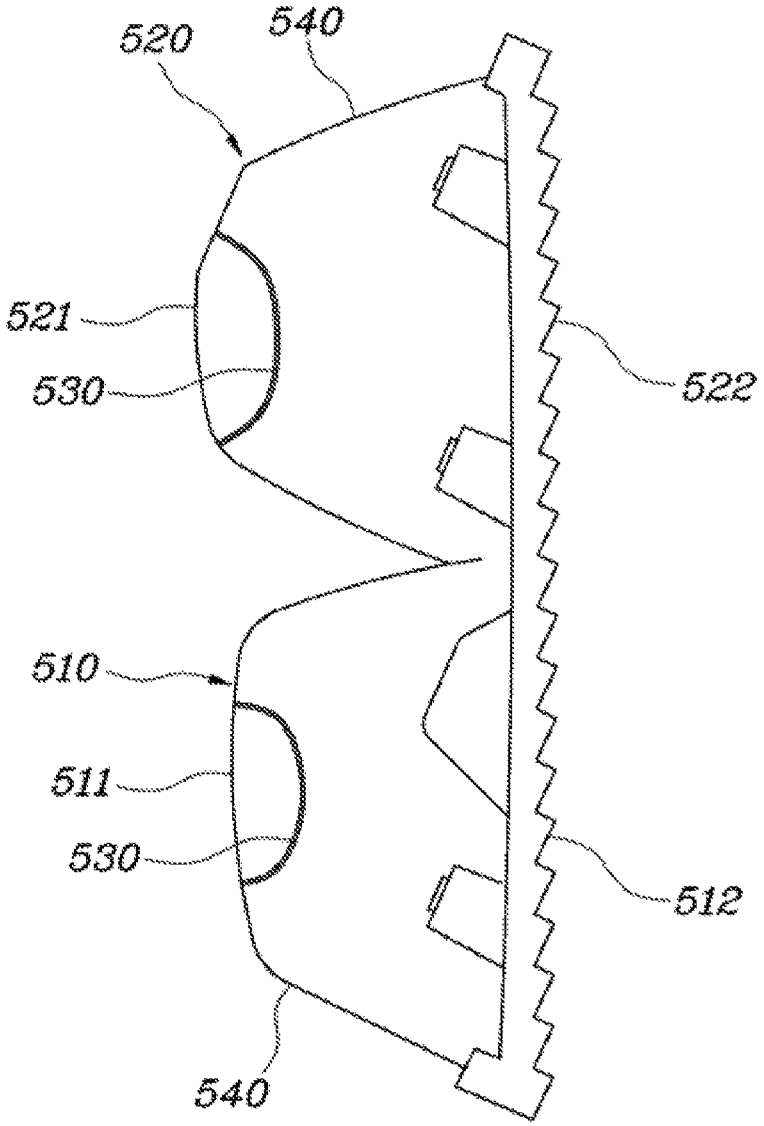

A lamp apparatus configured for a vehicle of the present invention relates to a low beam of a headlamp. FIG. 1 is a view showing a lamp apparatus configured for a vehicle according to an exemplary embodiment of the present invention, FIG. 2 and FIG. 3 are views for explaining various exemplary embodiments of a reflector according to the lamp apparatus configured for a vehicle shown in FIG. 1, and FIG. 4, FIG. 5 and FIG. 6 are views for explaining various exemplary embodiments of a reflector according to the lamp apparatus configured for a vehicle shown in FIG. 1.

A lamp apparatus configured for a vehicle according to an exemplary embodiment of the present invention, as shown in FIG. 1, includes: a light source 100 that radiates light; a polarizing filter 200 that receives the light radiated from the light source 100 and reflects forward a first-directional polarized beam and transmits a second-directional polarized beam by transmitting or reflecting the incident light, depending on the polarizing directions; a reflecting mirror 300 that receives the second-directional polarized beam that has passed through the polarizing filter 200, and reflects the incident second-directional polarized beam forward thereof; and a wavelength plate 400 which is disposed ahead of the reflecting mirror 300, receives the second-directional polarized beam reflected by the reflecting mirror 300, and converts the incident light into a first-directional polarized beam which is the same as the first-directional polarized beam reflected by the polarizing filter 200.

That is, the light radiated from one light source 100 is filtered into a first-directional polarized beam and a second-directional polarized beam by the polarizing filter 200 and the second-directional polarized beam is changed in course and converted into a first-directional polarized beam by the wavelength plate 400, whereby the light radiated from the light source 100 is sent out as the same first-directional polarized beam.

The light source 100 may be an LED to radiate light. The polarizing filter 200 and the reflecting mirror 300 are disposed in a course of the light radiated from the light source 100. The polarizing filter 200 is configured to transmit or reflect light, depending on the polarization direction thereof, such that the first-directional polarized beam is reflected forward and the second-directional polarized beam passes through the polarizing filter 200 and travels in the radiation direction of the light source 100. The polarizing filter 200 may have a tree-layered structure of TAC-PVA-TAC in which Tri-acetate cellulose (TAC) films that function as protectors for a polarizing element are bonded to both sides of the polarizing element around a Poly Vinyl Alcohol (PVA) film (polarizing element) dyed with a dichromatic material Surface coating that has characteristics of dispersion, hardness enhancement, and reflection etc. may be added, depending on the characteristics required for the surface of the TAC film.

The reflecting mirror 300 that the second-directional polarized beam, which has passed through the polarizing filter 200, reaches is a reflecting body that reflects incident light intact such that the second-directional polarized beam is reflected forward in the same direction as the first-directional polarized beam reflected by the polarizing filter 200. The present configuration may depend on the shape or the installation angle of the reflecting mirror 300.

As described above, the wavelength plate 400 is disposed in a course of the second-directional polarized beam changed in course by being reflected by the reflecting mirror 300 and converts the second-directional polarized beam into a first-directional polarized beam. The wavelength plate 400 is an optical element that changes the polarization state of light and has a thickness that generates a light time to change the wavelength of light.

Accordingly, light radiated from the light source 100 is filtered by the polarizing filter 200, so a first-directional polarized beam is radiated forward and a second-directional polarized beam is changed in course by the reflecting mirror 300 and then converted into a first-directional polarized beam by the wavelength plate 400 and radiated forward, whereby only a first-directional polarized beam having the same wavelength is finally sent out.

Accordingly, when light is radiated to a wet road surface, only a first-directional polarized beam which is not reflected by water is radiated to the road surface, so light reflection by water may be minimized and lighting feeling is improved by radiation of light with the same wavelength.

In detail, according to an exemplary embodiment of the present invention, the polarizing filter 200 and the reflecting mirror 300 are disposed in the traveling direction of light radiated from the light source 100 and the polarizing filter 200 reflects a p-polarized beam of the light radiated from the light source 100 and transmits an s-polarized beam, so that the s-polarized beam reaches the reflecting mirror 300.

That is, since the polarizing filter 200 and the reflecting mirror 300 are disposed in parallel in a course of the light which is radiated from the light source 100, the light radiated from the light source 100 is filtered into a different polarized beam by the polarizing filter 200. The course of the polarized beam that has passed through the polarizing filter 200 may be set such that the polarized beam is reflected to the wavelength plate 400 by the reflecting mirror 300.

Since the polarizing filter 200 reflects a forward p-polarized beam of the light radiated from the light source 100 and transmits an s-polarized beam to the reflecting mirror 300, only the p-polarized beam reflected by the polarizing filter 200 is sent out to a road surface. Since only a p-polarized beam is sent out through the polarizing filter 200, light reflection by water may be minimized.

This is based on Brewster's angle (polarizing angle) and utilizes the characteristic that an s-polarized beam which is perpendicular polarization is reflected when it reaches water and a p-polarized beam which is parallel polarization passes through water without reflecting when it reaches water. Brewster's angle is well-known in the art, so it is not described in detail.

Accordingly, when a low beam is radiated from the headlamp of the present invention, the light radiated from the light source 100 is filtered by the polarizing filter 200 and only a p-polarized beam is radiated to a road surface, so even if the road surface is wet, the p-polarized beam passes through the water without reflecting. Accordingly, light reflecting by water does not occur, so blinding people in oncoming vehicles may be prevented.

Meanwhile, the reflecting mirror 300 may be configured to transmit a p-polarized beam and reflect an s-polarized beam. The reflecting mirror 300 is also configured to transmit or reflect light, depending on the polarization directions, and reflects forward only an s-polarized beam, like the polarizing filter 200, whereby a polarized beam may be converted into a predetermined polarized beam by the wavelength plate 400. That is, by filtering only an s-polarized beam through the reflecting mirror 300, it is possible to allow only an s-polarized beam to reach the wavelength plate 400 and the wavelength plate 400 can convert the s-polarized beam having the same wavelength component into a p-polarized beam such that only the p-polarized beam is finally sent out.

The wavelength plate 400 may be configured to convert an s-polarized beam reflected by the reflecting mirror 300 into a p-polarized beam.

In an exemplary embodiment of the present invention, polarized beams having the same wavelength may be sent out. That is, when light is radiated from the light source 100, a p-polarized beam is sent out by the polarizing filter 200 and the other s-polarized beam is reflected to the wavelength plate 400 by the reflecting mirror 300. Since the wavelength plate 400 is configured to convert an s-polarized beam into a p-polarized beam, the s-polarized beam is converted into a p-polarized beam, so that the s-polarized beam may be sent out as a p-polarized beam having the same wavelength as the p-polarized beam filtered out by the polarizing filter 200.

As described above, the light radiated from the light source 100 is filtered by the polarizing filter 200, so a p-polarized beam is sent out and the other s-polarized beam is reflected by the reflecting mirror 300, converted into a p-polarized beam by the wavelength plate 400, and then sent out. Accordingly, the light which is finally sent out is a p-polarized beam, so it is not reflected by water due to Brewster's angle. Furthermore, the light which is sent out is a p-polarized beam having a uniform waveform, so lighting feeling is improved.

On the other hand, the present invention further includes a reflector 500 which is disposed ahead of the polarizing filter 200 and the reflecting mirror 300, receives the first-directional polarized beam reflected by the polarizing filter 200 and the first-directional polarized beam converted by the reflecting mirror 300 and the wavelength plate 400, and changes the course of the incident light so that the light is sent out to a road surface.

The reflector 500 is configured to receive the light reflected by the polarizing filter 200 and the reflecting mirror 300 and reflects and sends out the incident light as a low beam to a road surface.

The reflector 500 according to an exemplary embodiment of the present invention may be modified into various embodiments.

As various exemplary embodiments of the present invention, as shown in FIG. 2 and FIG. 3, the reflector 500 may include: a first lens unit 510 that receives a first-directional polarized beam reflected by the polarizing filter 200 and reflects the incident polarized beam to a road surface; and a second lens unit 520 that receives a first-directional polarized beam converted by the reflecting mirror 300 and the wavelength plate 400 and reflects the incident polarized beam to a road surface.

As shown in FIG. 2, the reflector 500 includes the first lens unit 510 and the second lens unit 520, in which the first lens unit 510 reflects the first-directional polarized beam reflected by the polarizing filter 200 to a road surface when receiving the first-directional polarized beam and the second lens unit 520 reflects the first-directional polarized beam, which has passed through the polarizing filer 200, has been reflected by the reflecting mirror 300, and then has been converted by the wavelength plate 400, to a road surface, like the first lens unit 510. The first lens unit 510 and the second lens unit 520 may be integrated and can send out beams to a road surface through the same course.

In detail, the first lens unit 510 has a light inlet portion 511 that receives the polarized beam reflected by the polarizing filter 200 and a light outlet portion 512 through which the polarized beam traveling inside through the light inlet portion 511 is sent out and the second lens unit 520 has a light inlet portion 521 that receives the polarized beam converted by the reflecting mirror 300 and the wavelength plate 400 and a light outlet portion 522 through which the polarized beam traveling inside through the light inlet portion 521 is sent out. The light outlet portion 512 of the first lens unit 510 and the light outlet portion 522 of the second lens unit 520 may extend and connected to each other in the arrangement direction of the polarizing filter 200 and the reflecting mirror 300.

The first lens unit 510 is disposed ahead of the polarizing filter 200 to receive the polarized beam reflected by the polarizing filter 200 and the second lens unit 520 is disposed ahead of the reflecting mirror 300 and the wavelength plate 400 to receive the polarized beam converted by the wavelength plate 400. Although described below, when the light radiated from the light source 100 travels as collimated light by a condenser 110, the light reflected by the polarizing filter 200 can reach the light inlet portion 511 of the first lens unit 510 and the light that has passed through the wavelength plate 400 after being reflected by the reflecting mirror 300 can reach the light inlet portion 521 of the second lens unit 520.

In an exemplary embodiment of the present invention, the light inlet portion 511 and the light inlet portion 521 are formed of a groove.

Furthermore, the light output portion 512 of the first lens unit 510 and the light output portion 522 of the second lens unit 520 extend and are connected to each other in the arrangement direction of the polarizing filter 200 and the reflecting mirror 300, so shading due to a gap between the light output portion 512 of the first lens unit 510 and the light output portion 522 of the second lens unit 520 may be minimized.

Meanwhile, as shown in FIG. 3, aspheric lenses 530 having a predetermined radius of curvature are disposed in the light inlet portions 511 and 521 of the first lens unit 510 and the second lens unit 520, and aspheric reflecting surfaces 540 having a predetermined radius of curvature to totally reflect the light refracting through the light inlet portions 511 and 521 to the light outlet portions 512 and 522 may be formed at the first lens unit 510 and the second lens unit 520.

That is, since the aspheric lenses 530 are disposed in the light inlet portions 511 and 521 of the first lens unit 510 and the second lens unit 520, the polarized beam traveling inside through the light inlet portion 511 of the first lens unit 510 and the polarized beam traveling inside through the light inlet portion 521 of the second lens unit 520 can travel forward as collimated light when they travel inside with an incident angle parallel with the optical axis, and they may be refracted to the reflecting surfaces 540 and then totally reflected forward by the reflecting surfaces 540 when they travel inside with an incident angle larger than the optical axis. Accordingly, the polarized beams traveling inside through the light input portions 511 and 521 of the first lens unit 510 and the second lens unit 520 are sent forward to a road surface by the aspheric lenses 530 in the light inlet portions and the reflecting surfaces 540, whereby light concentration efficiency may be improved.

Several optics or notches are formed at the light outlet portions 512 and 522 of the first lens unit 510 and the second lens unit 520, so that the light that has passed through the light outlet portions 512 and 522 may be diffused.

Since optics or notches are formed at the light outlet portions 512 and 522 of the first lens unit 510 and the second lens unit 520 so that light is diffused and sent out, light condensed in narrow light width areas by the light inlet portion 511 of the first lens unit 510 and the light inlet portion 521 of the second lens unit 520 is diffused and then sent out to a road surface. That is, using light which is diffused to a projection area of a road surface from narrow areas makes it possible to minimize an incident angle difference of polarized beams in the projection area of the road surface. Accordingly, the quality of light that reaches a road surface may be improved.

On the other hand, the light source 100 further includes a condenser 110 that converts radiated light into collimated light and the widths of the light inlet portions of the first lens unit 510 and the second lens unit 520 may be larger than the width of the light that has passed through the condenser 110.

That is, the light radiated from the light source 100 may be converted into collimated light with the course changed by the condenser 110 to travel to the polarizing filter 200 and the reflecting mirror 300. Since the widths of the light inlet portions of the first lens unit 510 and the second lens unit 510 are larger than the width of the light that has passed through the condenser 110, the polarized beam reflected by the polarizing filter 200 can reach the light inlet portion 511 of the first lens unit 510 and the polarized beam converted by the reflecting mirror 300 and the wavelength plate 400 can reach the light inlet portion 521 of the second lens unit 520, so optical loss may be minimized.

Figure 4:
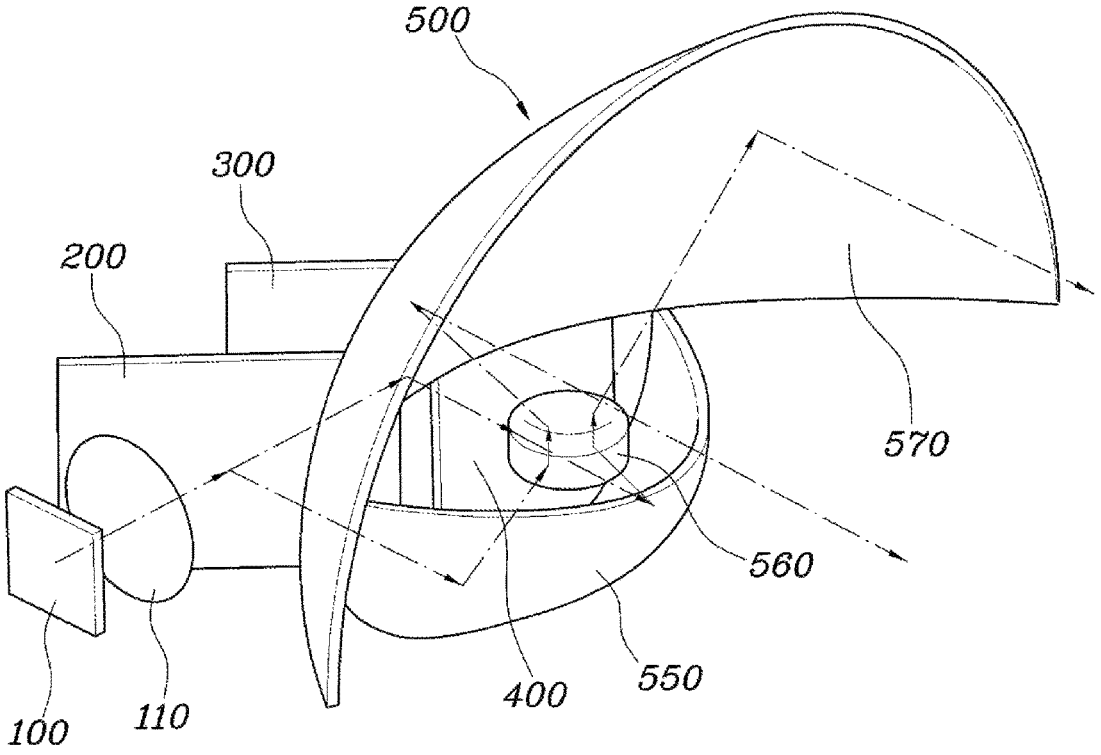
FIG. 4, FIG. 5 and FIG. 6 are views for explaining various exemplary embodiments of a reflector according to the lamp apparatus configured for a vehicle shown in FIG. 1.
Figure 5:
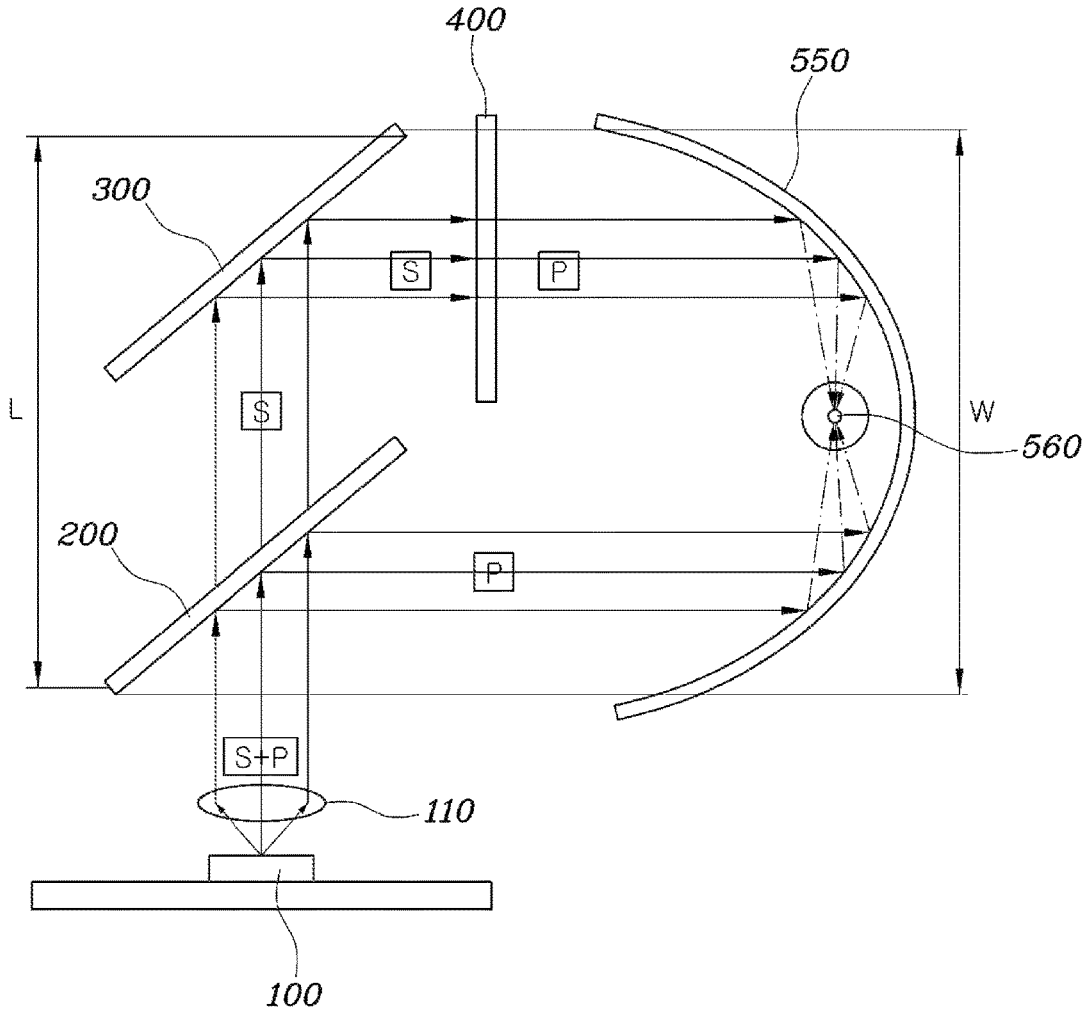
Figure 6:
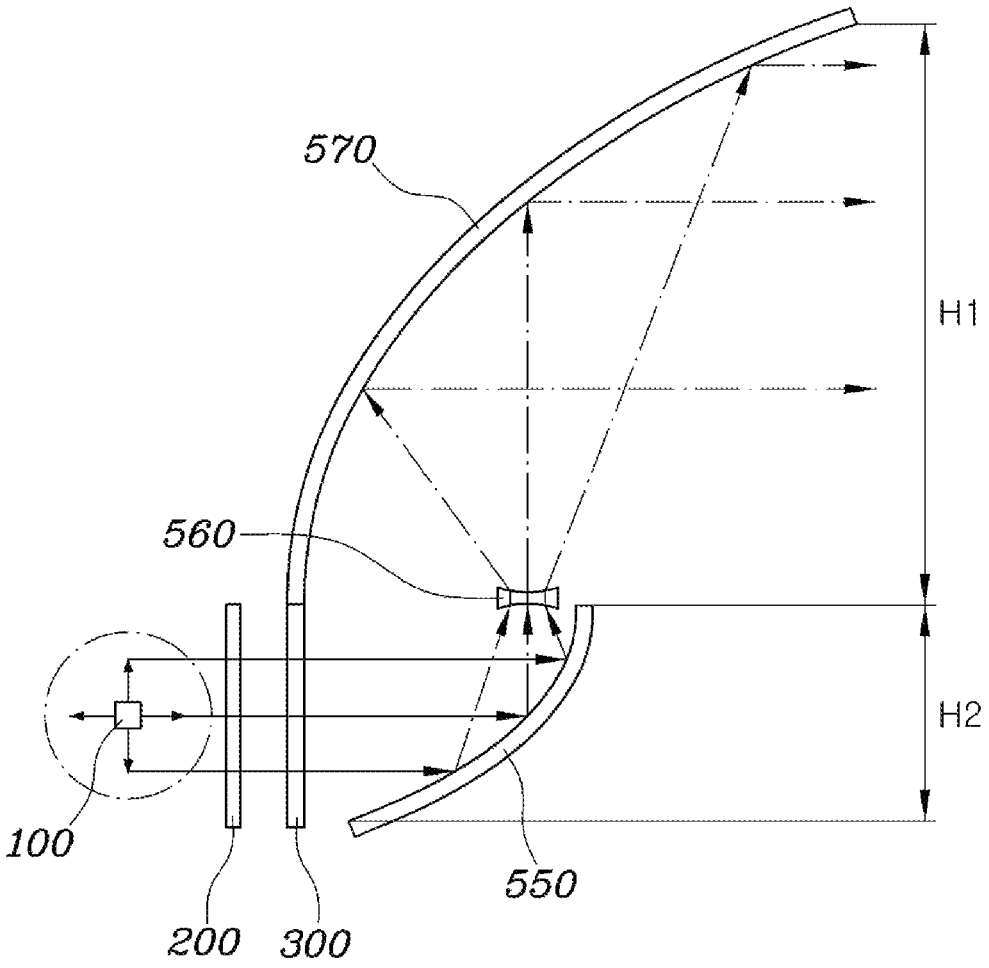

On the other hand, as various exemplary embodiments of the present invention, as shown in FIG. 4, FIG. 5 and FIG. 6, the reflector 500 may include: a condensing mirror 550 which is positioned to receive the first-directional polarized beam reflected by the polarizing filter 200 and the first-directional polarized beam converted by the reflecting mirror 300 and the wavelength plate 400 and condenses light at a focus by reflecting the incident polarized beams; a diffusing lens 560 which is positioned at the focus where the polarized beams are condensed by the condensing mirror 550 and diffuses the incident polarized beams; and a reflecting member 570 that reflects the light diffused by the diffusing lens 560 to a road surface on which a vehicle is driven.

As shown in FIG. 4, the reflector 500 includes the condensing mirror 550, the diffusing lens 560, and the reflecting member 570, in which the condensing mirror 550 is curved to condense the first-directional polarized beam reflected by the polarizing filter 200 and the first-directional polarized beam converted by the reflecting mirror 300 and the wavelength plate 400 at one focus. The diffusing lens 560 is disposed at the focus of the condensing mirror 550 such that the first-directional polarized beam reflected by the polarizing filter 200 and the first-directional polarized beam converted by the reflecting mirror 300 and the wavelength plate 400 that are condensed at one focus is omnidirectionally diffused to the reflecting member 570.

The reflecting member 570, which changes the course of light such that the first-directional polarized beams diffused through the diffusing lens 560 reach a road surface, may be a hyperbolic reflecting surface having a predetermined curvature. The radius of curvature and angle of the reflecting member 570 may be adjusted in accordance with the projection area of a road surface.

Accordingly, the light radiated from the light source 100 is divided into the first-directional polarized beam reflected by the polarizing filter 200 and the first-directional polarized beam converted by the reflecting mirror 300 and the wavelength plate 400 and the first-directional polarized beams are condensed to the diffusing lens 560 by the condensing mirror 550, are diffused to the reflecting member 570, are then sent out to a road surface by the reflecting member 570, whereby the light may be radiated as a low beam outside a vehicle.

As shown in FIG. 5, the width W of the condensing mirror 550 may be larger than the entire arrangement distance L of the polarizing filter 200 and the reflecting mirror 300. That is, the first-directional polarized beam reflected by the polarizing filter 200 and the first-directional polarized beam reflected by the reflecting mirror 300 and then converted by the wavelength plate 400 are both supposed to reach the condensing mirror 550 and the width W of the condensing mirror 550 is larger than the entire arrangement distance L of the polarizing filter 200 and the reflecting mirror 300, so all of the polarized beam reflected by the polarizing filter 200 and the reflecting mirror 300 can reach the condensing mirror 550.

Furthermore, as shown in FIG. 6, the height H1 of the reflecting member 570 is larger than the heights H2 of the condensing mirror 550, the polarizing filter 200, and the reflecting mirror 300, so that the reflecting member 570 can receive the entire light reflected by the condensing mirror 550 and then be diffused by the diffusing lens 560, so that the light can travel forward thereof.

By limiting the width of the condensing mirror 550 and the height of the reflecting member 570, as described above, optical loss may be minimized.

A lamp apparatus configured for a vehicle which has the structure described above radiates only a p-polarized beam without radiating an s-polarized beam which is reflected by water by filtering light which is radiated to a road surface which is wet by rain, preventing reflection of light by water. Therefore, it is possible to prevent light from blinding the people in oncoming vehicles, so safety from oncoming vehicles is secured. Furthermore, since light having a uniform waveform is radiated, lighting feeling is improved.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A lamp apparatus for a vehicle, the lamp apparatus comprising:

a light source that radiates light;

a polarizing filter that receives the light radiated from the light source and reflects forward a first incident light of a first-directional polarized beam and transmits a second-directional polarized beam, depending on polarizing directions of the polarizing filter;

a reflecting mirror that receives the second-directional polarized beam that has passed through the polarizing filter, and reflects a second incident light of the second-directional polarized beam forward thereof;

a wavelength plate which is mounted ahead of the reflecting mirror, receives the second incident light of the second-directional polarized beam reflected by the reflecting mirror, and converts the second incident light of the wavelength plate into a third-directional polarized beam which is a same as the first-directional polarized beam reflected by the polarizing filter; and a reflector which is mounted ahead of the polarizing filter and the reflecting mirror, receives the first-directional polarized beam reflected by the polarizing filter and the third-directional polarized beam converted by the wavelength plate, and changes a course of the first-directional polarized beam and the third-directional polarized beam so that the first-directional polarized beam and the third-directional polarized beam are sent out to a road surface.

2. The lamp apparatus of claim 1, wherein the light radiated from the light source is sent out as a same first-directional polarized beam.

3. The lamp apparatus of claim 2, wherein the second-directional polarized beam includes a s-polarized beam, and the third-directional polarized beam includes a second p-polarized beam, and wherein the wavelength plate is configured to convert the s-polarized beam reflected by the reflecting mirror into the second p-polarized beam.

4. The lamp apparatus of claim 1, wherein the first-directional polarized beam includes a first p-polarized beam and the second-directional polarized beam includes a s-polarized beam, and wherein the polarizing filter and the reflecting mirror are mounted in a traveling direction of the light radiated from the light source and the polarizing filter reflects the first p-polarized beam of the light radiated from the light source and transmits the s-polarized beam, so that the s-polarized beam reaches the reflecting mirror.

5. The lamp apparatus of claim 1, wherein the second-directional polarized beam includes a s-polarized beam, and the third-directional polarized beam includes a p-polarized beam, and wherein the wavelength plate is configured to convert the s-polarized beam reflected by the reflecting mirror into the p-polarized beam.

6. The lamp apparatus of claim 1, wherein the reflector includes:

a first lens unit that receives the first-directional polarized beam reflected by the polarizing filter and reflects the first-directional polarized beam to the road surface; and a second lens unit that receives the third-directional polarized beam which is the second-directional polarized beam converted by the wavelength plate and reflects the third-directional polarized beam to the road surface.

7. The lamp apparatus of claim 6, wherein the first lens unit includes a first light inlet portion that receives the first-directional polarized beam reflected by the polarizing filter and a first light outlet portion through which the first-directional polarized beam traveling inside through the first light inlet portion is sent out, and wherein the second lens unit has a second light inlet portion that receives the third-directional polarized beam and a second light outlet portion through which the third-directional polarized beam traveling inside through the second light inlet portion is sent out.

8. The lamp apparatus of claim 7, wherein the first light outlet portion of the first lens unit and the second light outlet portion of the second lens unit are formed to extend and connected to each other.

9. The lamp apparatus of claim 7, wherein the first light inlet portion of the first lens unit and the second light inlet portion of the second lens unit are formed of a groove, respectively.

10. The lamp apparatus of claim 7, wherein aspheric lenses having a predetermined radius of curvature are mounted in the first and second light inlet portions of the first lens unit and the second lens unit, and wherein aspheric reflecting surfaces having a predetermined radius of curvature to reflect the first-directional polarized beam and the third-directional polarized beam through the first and second light inlet portions to the first and second light outlet portions respectively, are formed at the first lens unit and the second lens unit.

11. The lamp apparatus of claim 7, wherein a plurality of optics or notches is formed at the first and second light outlet portions of the first lens unit and the second lens unit, so that the first-directional polarized beam and the third-directional polarized beam that have passed through the first and second light outlet portions is diffused therethrough.

12. The lamp apparatus of claim 6, wherein the light source further includes a condenser that converts radiated light of the light source into collimated light, and wherein widths of the first lens unit and the second lens unit are larger than a width of the light that has passed through the condenser.

13. The lamp apparatus of claim 1, wherein the reflector includes:

a condensing mirror which is mounted to receive the first-directional polarized beam reflected by the polarizing filter and the third-directional polarized beam and condenses the first-directional polarized beam and the third-directional polarized beam at a focus of the condensing mirror by reflecting the first-directional polarized beam and the second-directional polarized beam therefrom;

a diffusing lens which is mounted at the focus of the condensing mirror where the first-directional polarized beam and the second-directional polarized beam are condensed by the condensing mirror and diffuses the first-directional polarized beam and the second-directional polarized beam; and a reflecting member that reflects the first-directional polarized beam and the third-directional polarized beam diffused by the diffusing lens to the road surface on which a vehicle is driven.

14. The lamp apparatus of claim 13, wherein a width of the condensing mirror is larger than an entire arrangement distance of the polarizing filter and the reflecting mirror.

15. The lamp apparatus of claim 13, wherein a height of the reflecting member is larger than heights of the condensing mirror, the polarizing filter, and the reflecting mirror.

* * * * *